US012320139B2

(12) United States Patent
Yang et al.

(10) Patent No.: US 12,320,139 B2
(45) Date of Patent: Jun. 3, 2025

(54) COLLAPSIBLE CANOPY WITH MOBILITY DEVICE

(71) Applicant: WITH-U E-COMMERCE (SHANGHAI) CO., LTD., Shanghai (CN)

(72) Inventors: Shengyong Yang, Shanghai (CN); Jing Bian, Shanghai (CN)

(73) Assignee: WITH-U E-COMMERCE (SHANGHAI) CO., LTD., Shanghai (CN)

( * ) Notice: Subject to any disclaimer, the term of this patent is extended or adjusted under 35 U.S.C. 154(b) by 159 days.

(21) Appl. No.: 17/870,146

(22) Filed: Jul. 21, 2022

(65) Prior Publication Data

US 2022/0356725 A1 Nov. 10, 2022

Related U.S. Application Data

(63) Continuation-in-part of application No. 15/947,792, filed on Apr. 7, 2018, now Pat. No. 11,434,656.

(51) Int. Cl.

| | |
|---|---|
| ***E04H 15/48*** | (2006.01) |
| ***E04H 15/02*** | (2006.01) |
| ***E04H 15/54*** | (2006.01) |

(52) U.S. Cl.

CPC ..... *E04H 15/02* (2013.01); *E04H 15/48* (2013.01); *E04H 15/54* (2013.01)

(58) Field of Classification Search

CPC ..... E04H 15/48; E04H 15/50

See application file for complete search history.

(56) References Cited

U.S. PATENT DOCUMENTS

| | | | | |
|---|---|---|---|---|
| 4,779,635 | A | 10/1988 | Lynch | |
| 5,511,572 | A | 4/1996 | Carter | |
| 5,704,475 | A * | 1/1998 | Jack | A63B 55/406 206/315.6 |
| 5,944,155 | A * | 8/1999 | Geary | A45C 7/0045 190/110 |
| 5,975,170 | A | 11/1999 | Anguiano | |
| 6,361,057 | B1 | 3/2002 | Carter | |
| 7,673,643 | B2 | 3/2010 | Seo | |
| 10,253,523 | B2 | 4/2019 | Volin | |
| 2002/0074032 | A1 | 6/2002 | Park | |
| 2010/0282381 | A1 | 11/2010 | Badertscher | |
| 2012/0325279 | A1 | 12/2012 | Munoz | |
| 2015/0183352 | A1 | 7/2015 | Bowe | |
| 2015/0202108 | A1 | 7/2015 | Kilian | |
| 2016/0060896 | A1 | 3/2016 | Toohey | |
| 2017/0296890 | A1 | 10/2017 | Maguire | |
| 2019/0153743 | A1 * | 5/2019 | Perreault | A45B 25/00 |

* cited by examiner

*Primary Examiner* — Noah Chandler Hawk

(74) *Attorney, Agent, or Firm* — Schmeiser, Olsen & Watts LLP

(57) ABSTRACT

A wheeled collapsible canopy with foldable support frame is provided. The wheeled collapsible canopy includes at least two wheeled legs and at least two non-wheeled legs. A protective cover covers the top of the collapsible canopy when the collapsible canopy is in a folded state. The protective cover extends only partially down the length of the folded support frame.

11 Claims, 22 Drawing Sheets

COLLAPSIBLE CANOPY WITH MOBILITY DEVICE

CROSS REFERENCE TO RELATED APPLICATIONS

This application is a continuation-in-part application of U.S. application Ser. No. 15/947,792, filed on Apr. 7, 2018, the entire contents of which are hereby incorporated by reference.

FIELD OF TECHNOLOGY

The following relates to a collapsible canopy with mobility device.

BACKGROUND

Collapsible canopies that are capable of being locked into an unfolded position are very popular in modern society. Generally, each canopy comprises a foldable canopy frame and a canopy fabric, the canopy frame consists of a roof frame and four or more supporting legs, the supporting legs are used for supporting the roof frame and are generally provided with a locking structure on each supporting leg respectively, the canopy fabric covers the roof frame and is used for sun shading, rain sheltering or wind sheltering. The supporting legs are extendable to approximately twice their stowed length.

Collapsible canopies are utilized for shade and shelter purposes when the canopy is in an unfolded state. When it is time to move the canopy, the user will fold the collapsible canopy to a folded state so that it can be more easily transported. In the conventional art the user will generally stuff the folded canopy into a transport bag. The transport bag usually has wheels so that the user can pull the canopy rather than having to lift it. Unfortunately, it can be time consuming and difficult to stuff the folded, collapsed canopy into the transport bag. Often the transport bag will rip and tear with age and usage.

What is needed is an improved collapsible canopy that allows for more efficient transportation of the collapsible canopy.

SUMMARY

An aspect relates to a wheeled collapsible canopy with foldable support frame. The wheeled collapsible canopy includes at least two wheeled legs and also at least two non-wheeled legs. A protective cover covers the top of the collapsible canopy when the collapsible canopy is in a folded state. The protective cover extends only partially down the length of the folded support frame.

BRIEF DESCRIPTION

Some of the embodiments will be described in detail, with references to the following Figures, wherein like designations denote like members, wherein.

DETAILED DESCRIPTION

Figure 1:
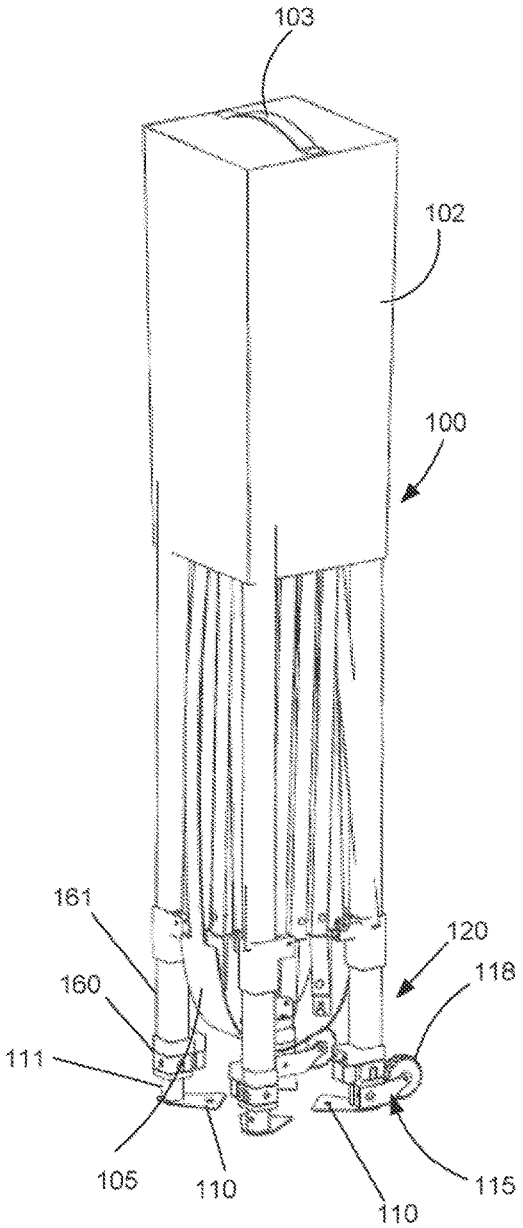
FIG. 1 shows a first preferred embodiment of the present disclosure.
Figure 2:
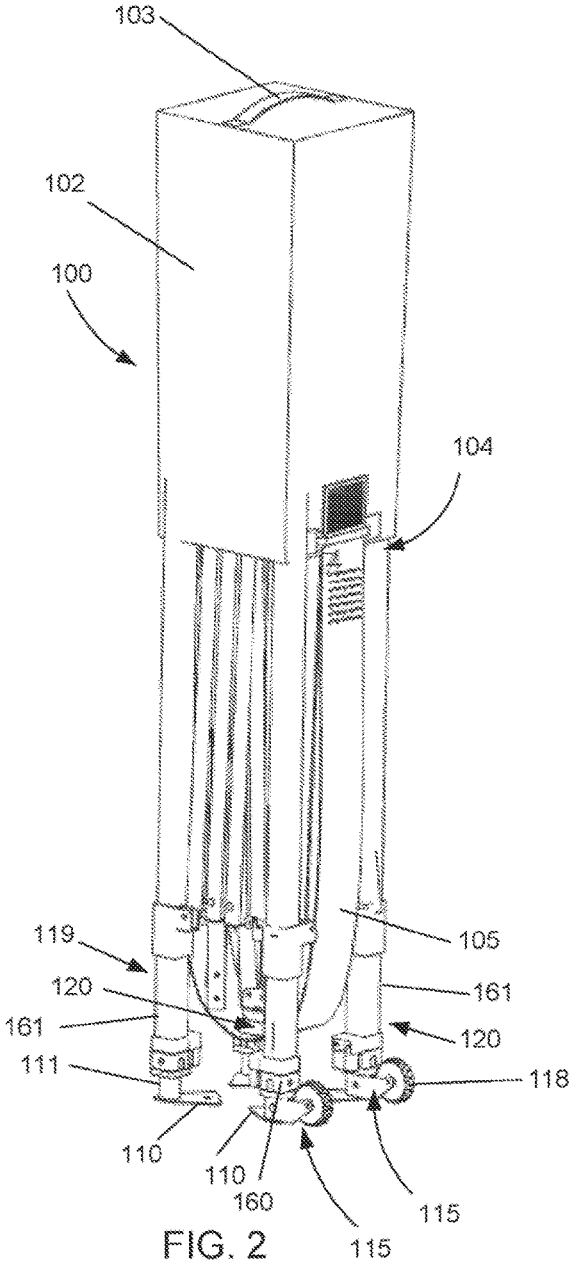
FIG. 2 shows a first embodiment of the present disclosure.
Figure 3:
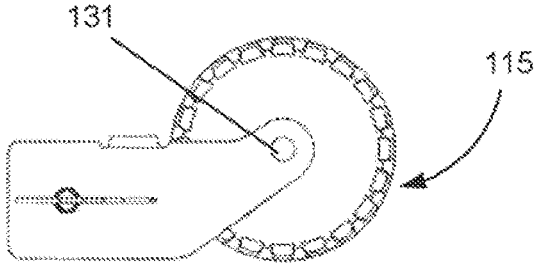
FIG. 3 shows a first embodiment of the present disclosure.
Figure 4:
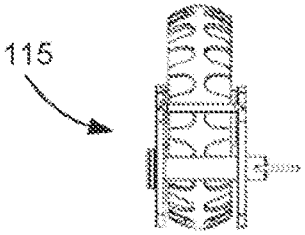
FIG. 4 shows a first embodiment of the present disclosure.
Figure 5:
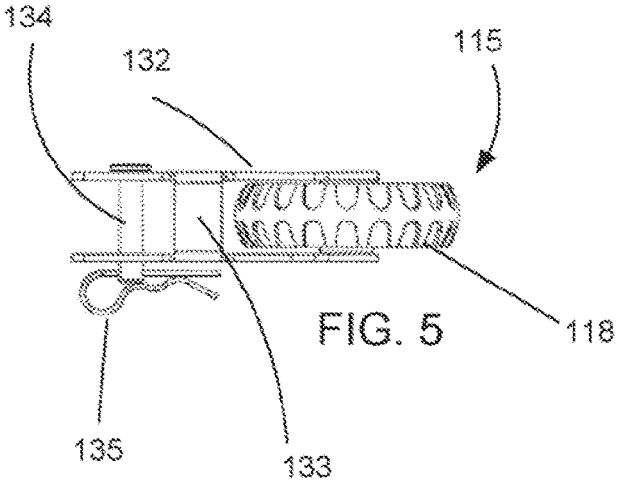
FIG. 5 shows a first embodiment of the present disclosure.
Figure 6:
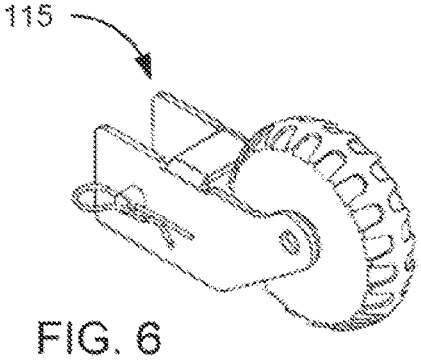
FIG. 6 shows a first embodiment of the present disclosure.

FIGS. 1 and 2 show collapsible canopy 100 in a folded state. Feet 110 support canopy 100 upright as shown. To transport canopy 100, the user will tilt the canopy and pull it while walking. Canopy 100 will roll on wheels 118 of wheeled mechanism 115. Because two canopy legs include wheels 118 of wheeled mechanism 115, it is unnecessary to stuff collapsed canopy 100 into a transport bag having wheels. Instead, only a much smaller protective cover is utilized. This greatly reduces the amount of time and work required to fold and then transport the collapsed canopy.

In FIGS. 1 and 2, protective cover 102 has been slid over the top of collapsible canopy 100. Protective cover 102 extends only partially down from the top of collapsible canopy 100. This makes it much easier to install and remove protective cover 102 from collapsible canopy 100. Strap 105 secures protective cover 102 on top of canopy 100. Strap 103 includes hook and loop fastener 104 for securing strap 5 as shown. Handle 103 permits a user to easily pull canopy 100 during transportation.

Horizontal feet 110 are welded to the bottom of extendable legs 111 to allow for greater stability of canopy 100. For wheeled legs 120 and for non-wheeled legs 119, spring loaded position locking clips 160 are rigidly connected to the bottom ends of outer leg sleeves 161. For both wheeled legs 120, wheel mechanisms 115 is connected to inner telescoping extendable leg 111 immediately above each foot 110. Wheel mechanisms 115 allow the user to tilt canopy 100 while canopy 100 is in its folded state. The user can then pull canopy 100 by grasping handle 103 and walking. Canopy 100 will then easily roll while supported by wheels of 118 of wheel mechanisms 115.

FIGS. 3-6 show detailed views of wheel mechanism 115. Wheel mechanism 115 includes wheel 118 rotatably connected via axle 131 to horizontal wheel bracket 132. Stabilizing brace 133 is rigidly connected to horizontal extension 132. Connection bolt 134 extends through horizontal wheel bracket 132 is secured by cotter pin 135.

Figure 7:
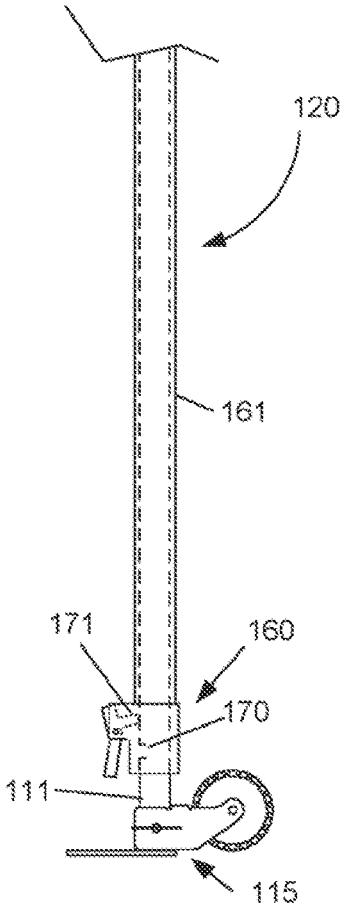
FIG. 7 shows a first embodiment of the present disclosure.
Figure 8:
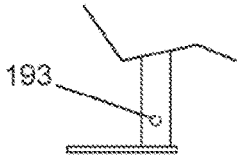
FIG. 8 shows a first embodiment of the present disclosure.
Figure 10:
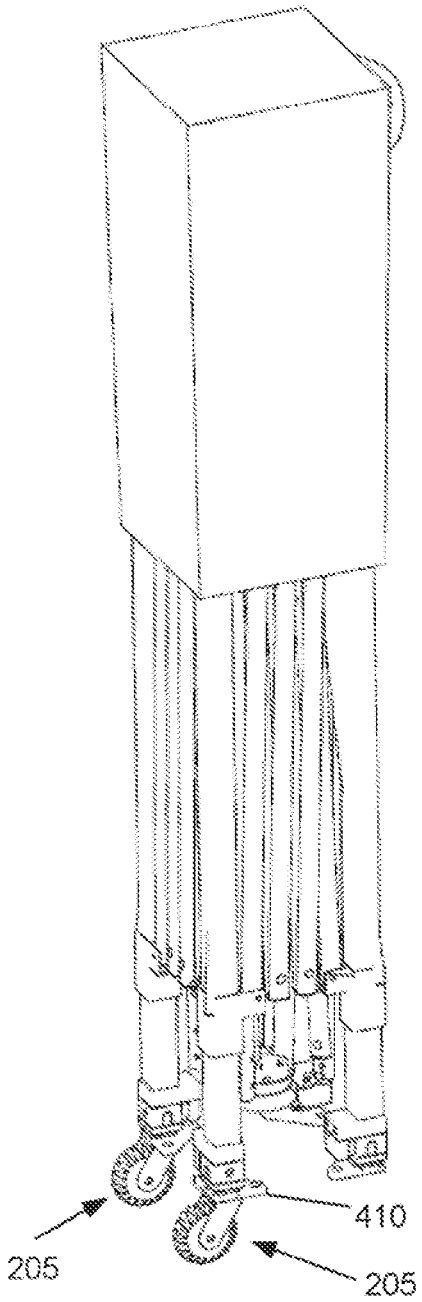
FIG. 10 shows a second preferred embodiment of the present disclosure.
Figure 11:
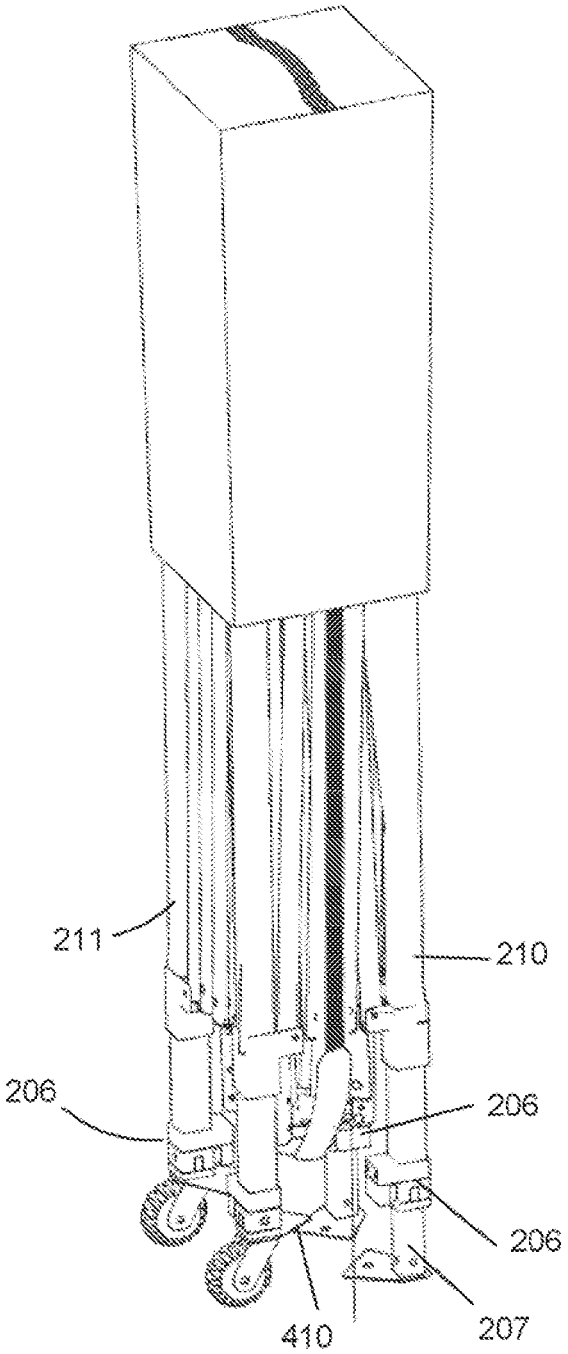
FIG. 11 shows a second preferred embodiment of the present disclosure.

FIG. 7 shows wheeled mechanism attached to the bottom of extendable leg 111 and positioned immediately above foot 110. To connect wheeled mechanism 115, the user inserts connection bolt 134 through hole 193 (FIG. 8) and secures connection bolt 134 with cotter pin 135 as described above.

Figure 9:
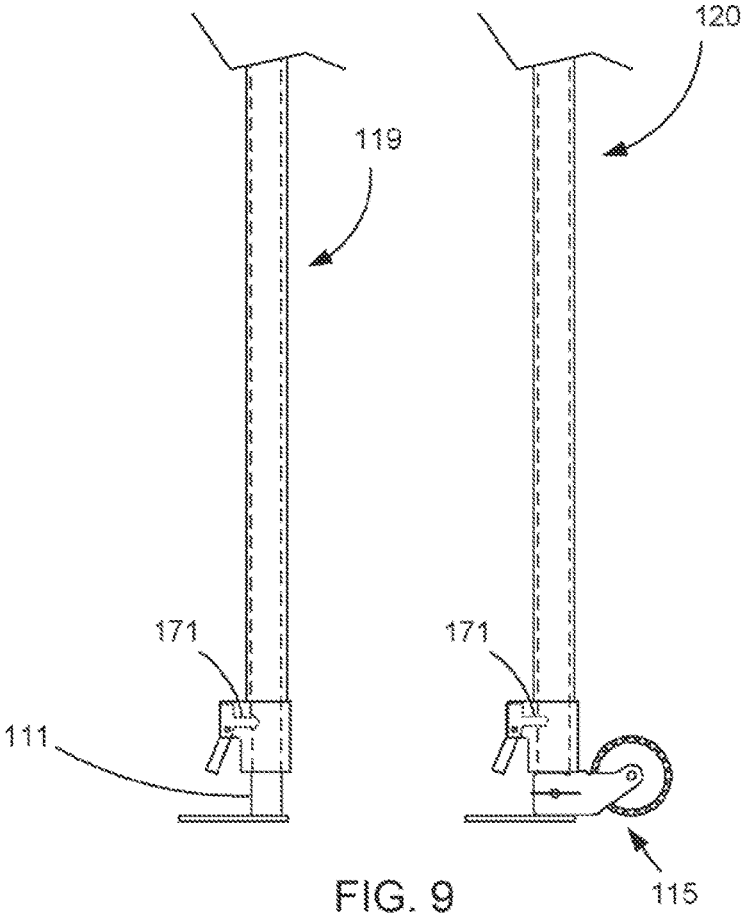
FIG. 9 shows a first embodiment of the present disclosure.

In FIG. 7, spring loaded position locking clip 160 is connected to the bottom of outer leg sleeve 161. However, extendable leg 111 is not yet locked into position. To lock extendable leg 111 into position the user moves wheeled mechanism 115 upwards until opening 170 is aligned with knob 171. For example, in FIG. 9, for wheeled leg 120 and non-wheeled leg 119, opening 170 is aligned with knob 171, thereby locking extendable leg 111 into place as shown. It should be noted that locking clips 160 allow the user to lock into place the height of non-wheeled legs 119 so that they match the heights of wheeled legs 120, as shown in FIGS. 9, 1 and 2.

Second Preferred Embodiment

A second preferred embodiment of the present invention is shown in FIGS. 10-14. In the second preferred embodiment wheeled mechanism 115 has been replaced with wheeled mechanism 205. Wheeled mechanism 205 attaches to the bottom of extendable legs 207 for two of the extendable legs, as shown. Non-wheeled legs 210 include spring loaded position locking clips 206 to lock extendable leg 207 in position so that the height of non-wheeled legs 210 is equal to the height of wheeled legs 211.

Figure 12:
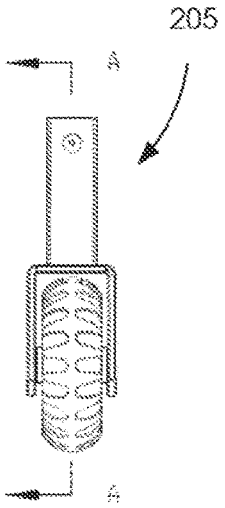
FIG. 12 shows a second preferred embodiment of the present disclosure.
Figure 13:
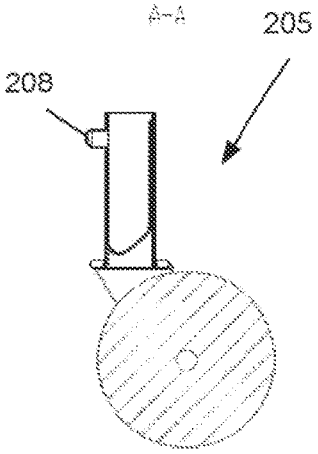
FIG. 13 shows a second preferred embodiment of the present disclosure.
Figure 14:
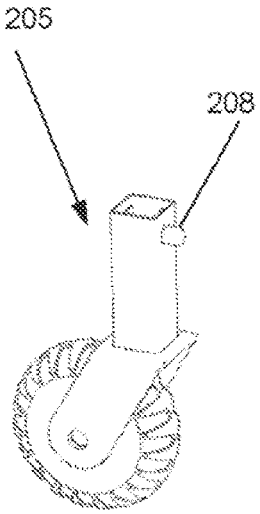
FIG. 14 shows a second preferred embodiment of the present disclosure.

FIGS. 12-14 show other views of wheeled mechanism 205. Horizontal support feet 410 each include an aperture for receiving wheeled mechanism 205. Wheeled mechanism 205 includes spring loaded push pin 208 for locking wheeled mechanism 205 into place into extendable leg 207.

Third Preferred Embodiment

A third preferred embodiment of the present invention is shown in FIGS. 15A-18E. In the third preferred embodiment wheeled mechanism 115 has been replaced with wheeled mechanism 225. Wheeled mechanism 225 attaches to the bottom of extendable legs 111 for two of the extendable legs to form two wheeled legs. As with the earlier embodiments, there are also two non-wheeled legs.

Figure 15A:
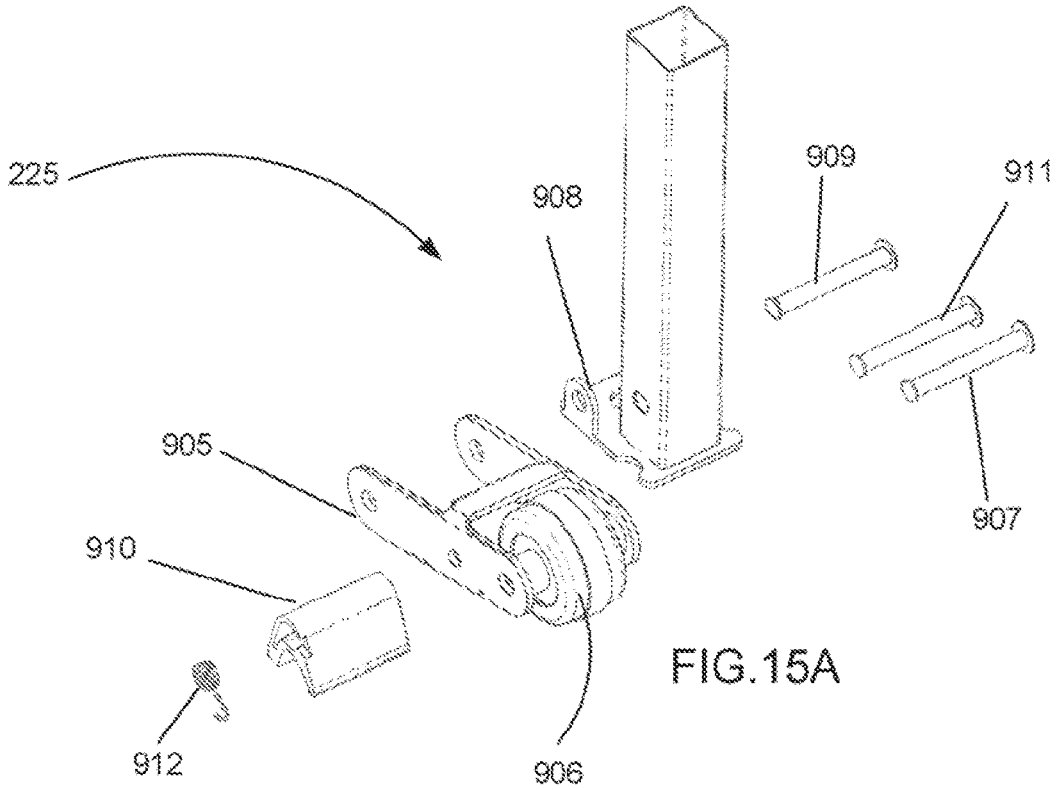
FIG. 15A shows a third embodiment of the present disclosure.

FIG. 15A shows an exploded view of wheeled mechanism 225. Wheeled mechanism 225 includes wheel bracket 905. Wheel bracket 905 is rotatably connected to foot 908 via axle 909. Wheel 906 is rotatably connected to wheel bracket 905 via axle 907. Spring loaded locking clip 910 is rotatably connected to wheel bracket 905 via axle 911. Spring 912 is housed within locking clip 910 and is biased to keep locking clip 910 in the position shown in FIGS. 15C and 18C.

FIGS. 15B-18C show the movement of wheeled mechanism from a preferred stowage position to a preferred position for mobility.

Figure 15B:
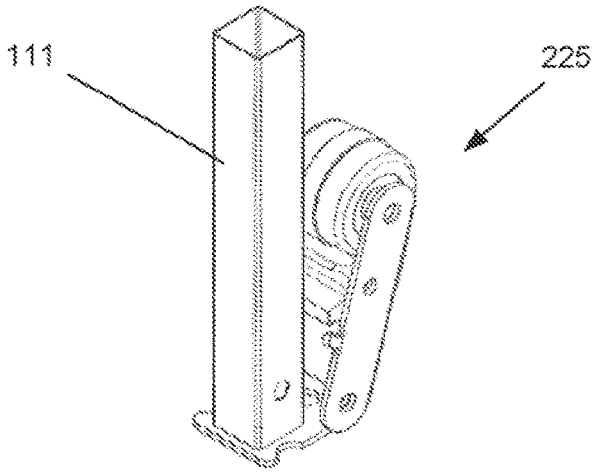
FIG. 15B shows a third embodiment of the present disclosure.
Figure 15C:
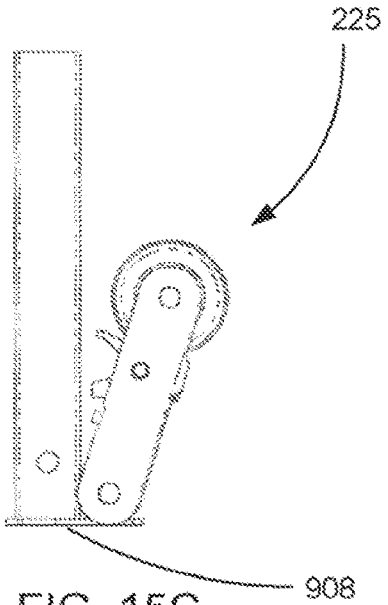
FIG. 15C shows a third embodiment of the present disclosure.

FIGS. 15B-15C shows wheeled mechanism 225 rotatably connected to foot 908 of inner extendable leg 111.

Figure 16A:
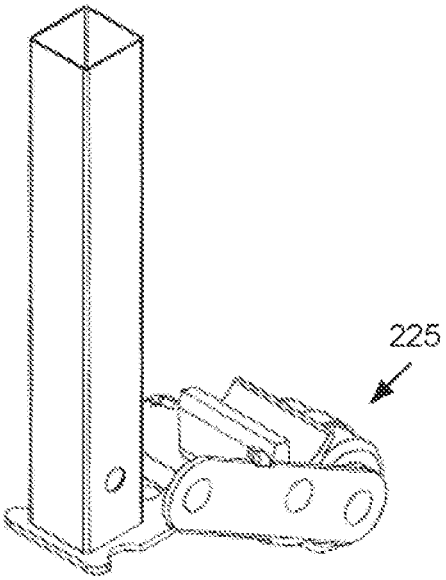
FIG. 16A shows a third embodiment of the present disclosure.
Figure 16B:
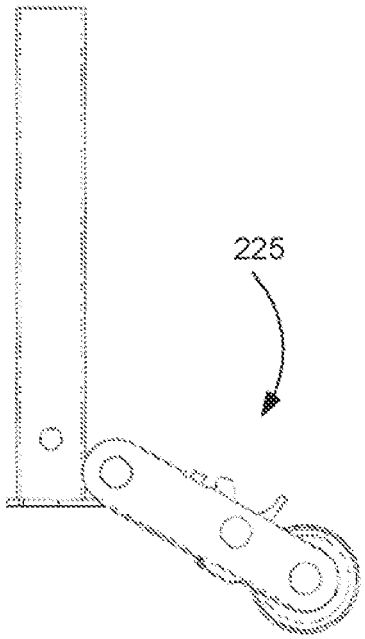
FIG. 16B shows a third embodiment of the present disclosure.

In FIGS. 16A-16B the user has begun to rotate wheeled mechanism 225 clockwise.

Figure 16C:
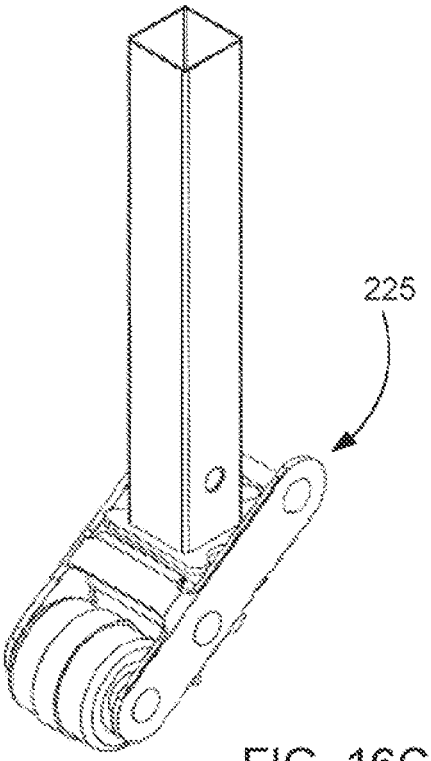
FIG. 16C shows a third embodiment of the present disclosure.
Figure 16D:
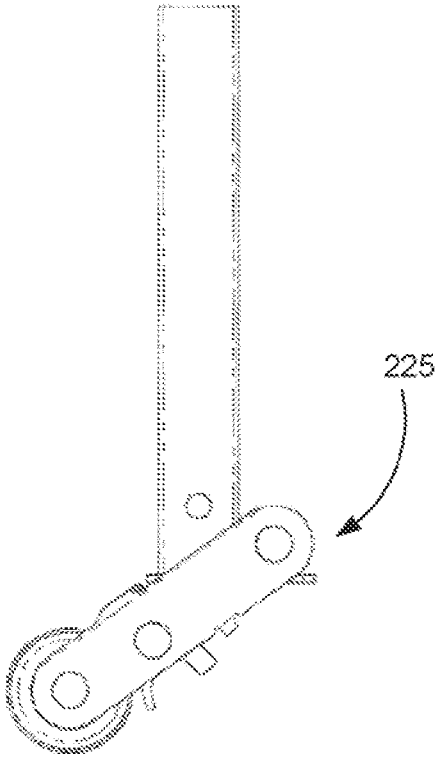
FIG. 16D shows a third embodiment of the present disclosure.

In FIGS. 16C-16D the user has continued the clockwise rotation of wheeled mechanism 225.

Figure 17A:
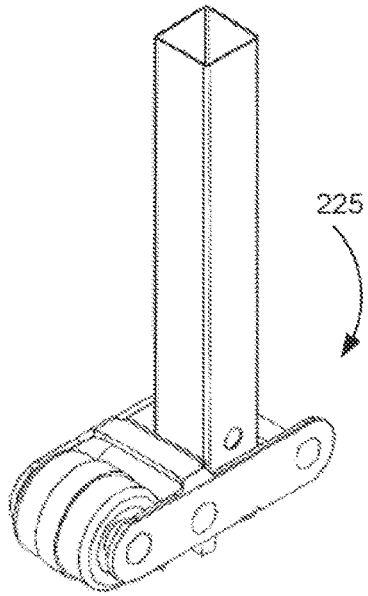
FIG. 17A shows a third embodiment of the present disclosure.
Figure 17B:
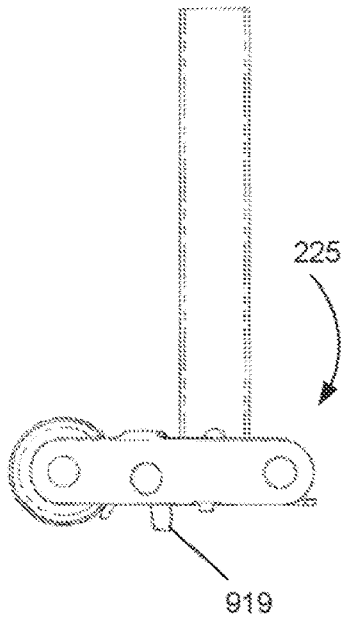
FIG. 17B shows a third embodiment of the present disclosure.
Figure 17C:
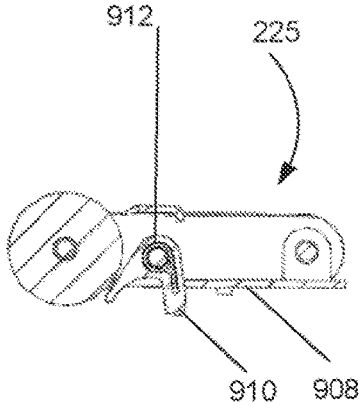
FIG. 17C shows a third embodiment of the present disclosure.

In FIGS. 17A-17C the user has further continued the clockwise rotation of wheeled mechanism 225. Locking clip 910 has run abut foot 908, causing it to rotate clockwise against the bias provided by spring 912.

Figure 17D:
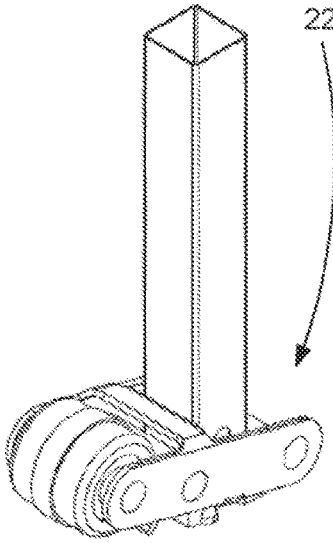
FIG. 17D shows a third embodiment of the present disclosure.
Figure 17E:
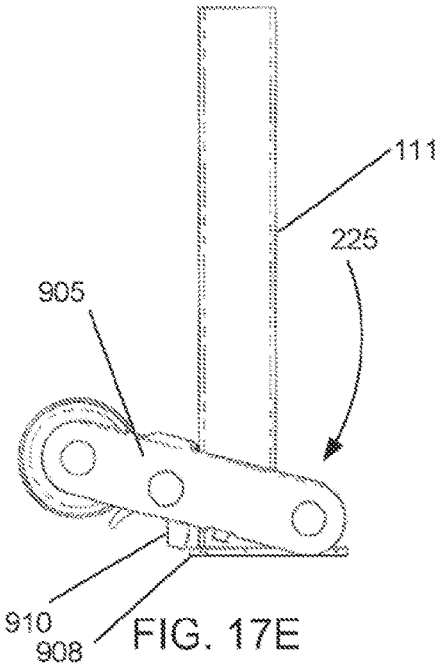
FIG. 17E shows a third embodiment of the present disclosure.
Figure 17F:
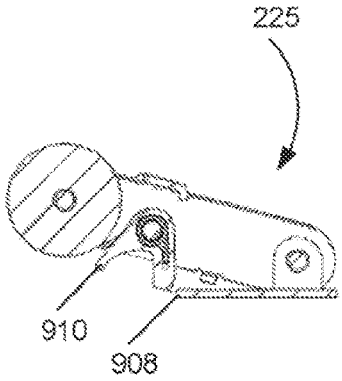
FIG. 17F shows a third embodiment of the present disclosure.

In FIGS. 17D-17F the user has further continued the clockwise rotation of wheeled mechanism 225. Locking clip 910 is shown just as it clears foot 908. Wheel bracket 905 has run abut inner extendable leg 111 to prevent further rotation of wheel bracket 905.

Figure 18A:
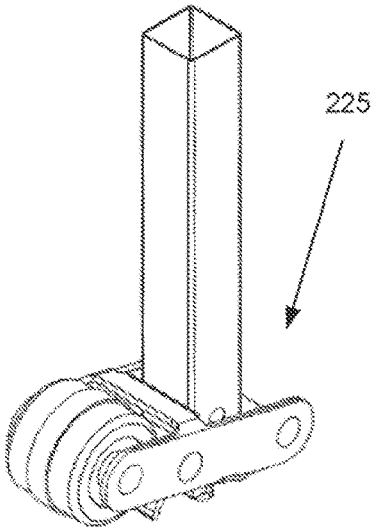
FIG. 18A shows a third embodiment of the present disclosure.
Figure 18B:
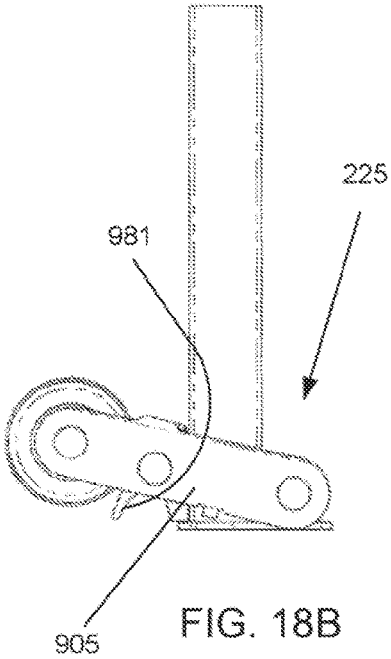
FIG. 18B shows a third embodiment of the present disclosure.
Figure 18C:
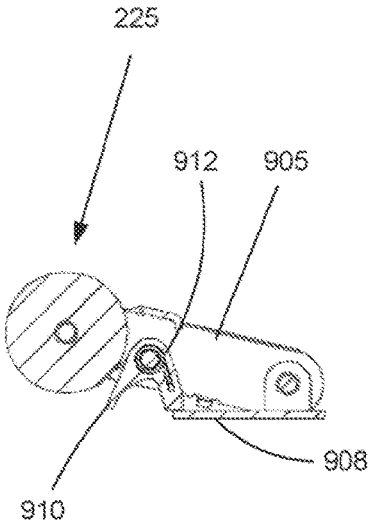
FIG. 18C shows a third embodiment of the present disclosure.

In FIGS. 18A-18C, spring 912 has rotated locking clip 910 counterclockwise so that locking clip 910 is now wedged above foot 908, thereby locking wheel bracket 905 into the position shown.

Figure 18D:
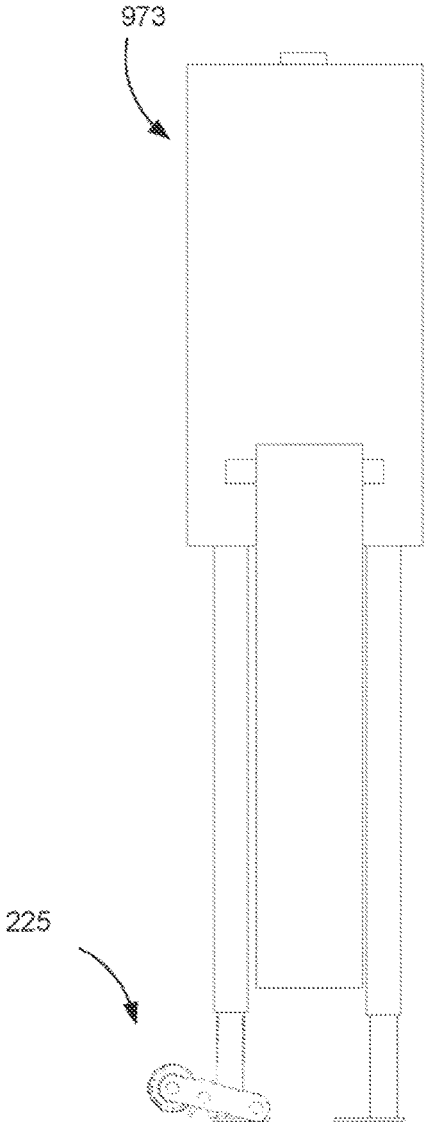
FIG. 18D shows a third embodiment of the present disclosure.
Figure 18E:
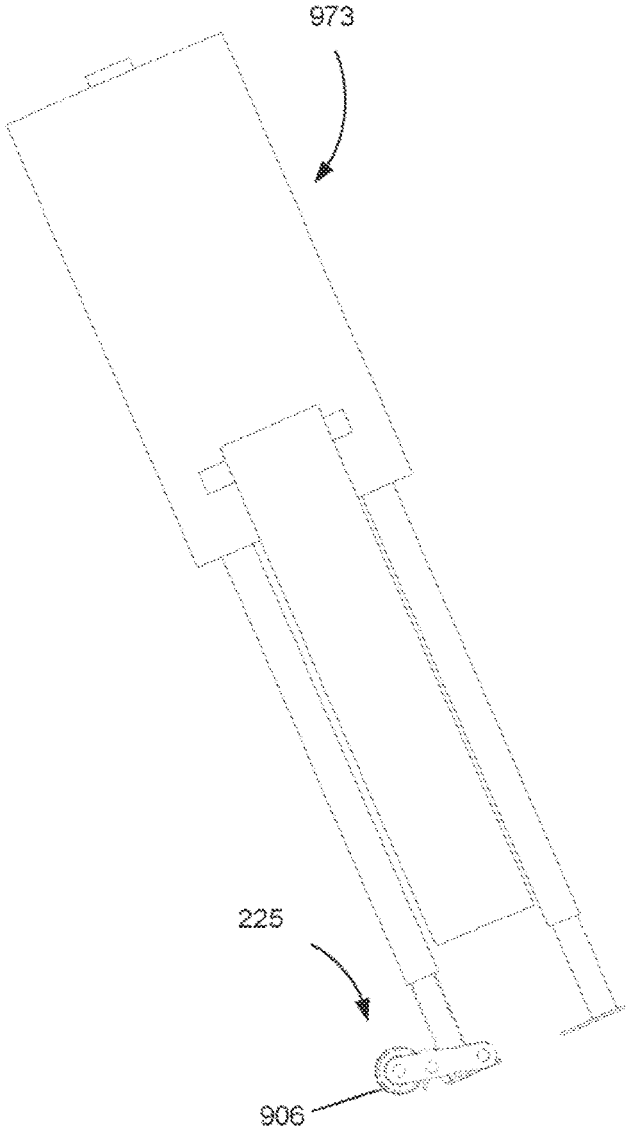
FIG. 18E shows a third embodiment of the present disclosure.

FIGS. 18D-18E show collapsed canopy 973 with wheeled mechanism 225. In FIG. 18E, the user has tilted collapsed canopy 973 and can now pull it to the left. Canopy 973 will roll easily on wheels 906 of wheeled mechanism 225.

Locking clip 910 can be disengaged from a locked position easily by pressing on tab 981 (FIG. 18B) so that locking clip 910 is no longer wedged against foot 908.

Fourth Preferred Embodiment

A fourth preferred embodiment of the present invention is shown in FIGS. 19A-31. In the fourth preferred embodiment wheeled mechanism 115 has been replaced with wheeled mechanism 255. Wheeled mechanism 255 included bias spring 295 (FIG. 20). Wheeled mechanism 255 attaches to the bottom of extendable legs 111 for two of the extendable legs to form two wheeled legs. As with the earlier embodiments, there are also two non-wheeled legs.

Figure 19B:
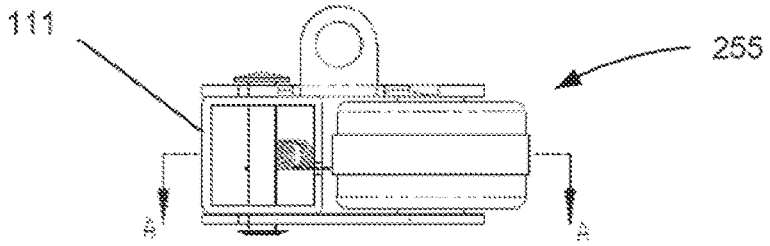
FIG. 19B shows a fourth preferred embodiment of the present disclosure.
Figure 19A:
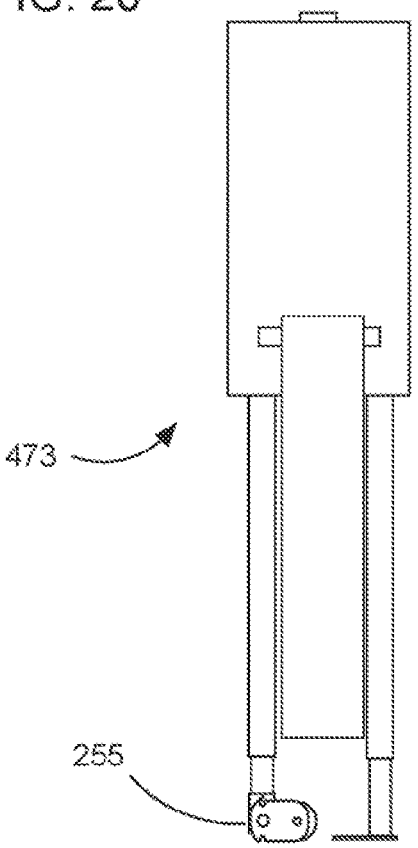
FIG. 19A shows a fourth preferred embodiment of the present disclosure.

FIG. 19A shows a side view of collapsed, folded canopy 473. Wheeled mechanism 255 is facing rightward in the preferred position for storage and packing. However, to use wheeled mechanism 255 for mobility it must be positioned facing leftward.

Figure 20:
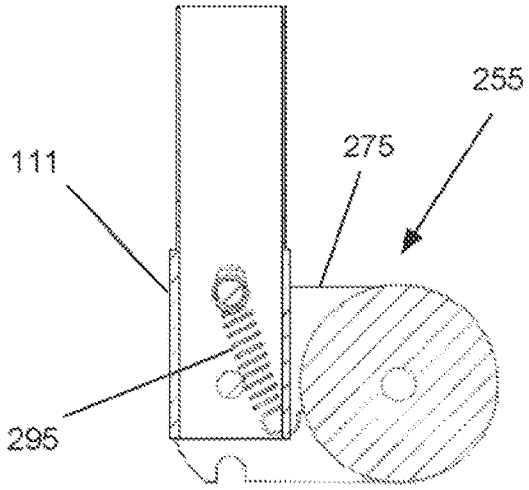
FIG. 20 shows a fourth preferred embodiment of the present disclosure.
Figure 21:
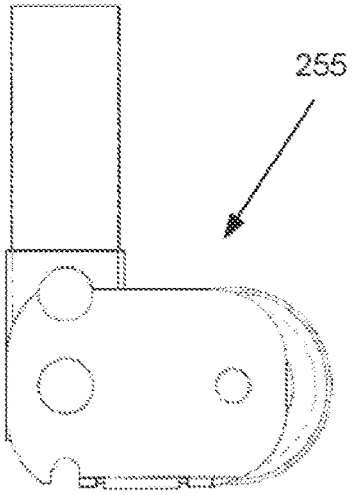
FIG. 21 shows a fourth preferred embodiment of the present disclosure.

As shown in FIGS. 19B and 20, spring 295 is connected between sliding spring bar 333 and the bottom edge of inner extendable leg 111. FIG. 20 shows a cutaway view of wheeled mechanism 255 and FIG. 21 shows a side view of wheeled mechanism 255.

Figure 22:
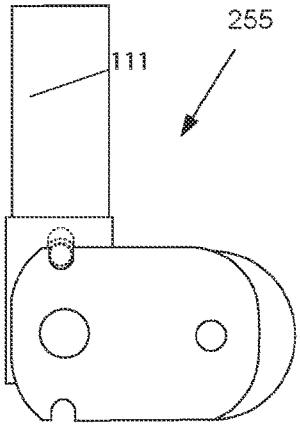
FIG. 22 shows a fourth preferred embodiment of the present disclosure.
Figure 23A:
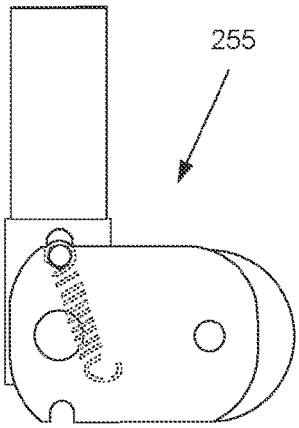
FIG. 23A shows a fourth preferred embodiment of the present disclosure.
Figure 23B:
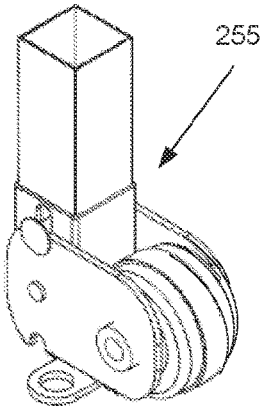
FIG. 23B shows a fourth preferred embodiment of the present disclosure.

In FIGS. 22-23B, wheeled mechanism 255 is in position for storage and facing to the right. To utilize wheeled mechanism 255 for mobility the user needs to rotate wheeled mechanism 255 clockwise so that it is facing to the left.

Figure 24:
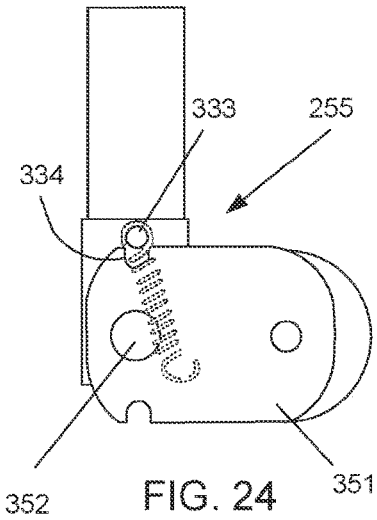
FIG. 24 shows a fourth preferred embodiment of the present disclosure.

In FIG. 24 the user has slid spring bar 333 upwards so that it no longer engages slot 334 of wheel bracket 351. Wheel bracket 351 is now free to rotate about rotation axle 352.

Figure 25A:
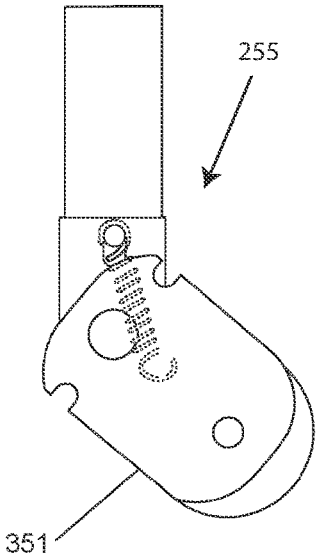
FIG. 25A shows a fourth preferred embodiment of the present disclosure.
Figure 25B:
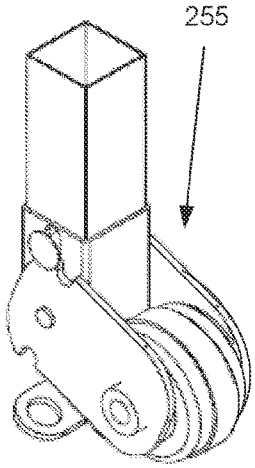
FIG. 25B shows a fourth preferred embodiment of the present disclosure.

In FIGS. 25A-25B the user has started to rotate wheel bracket 351 clockwise.

Figure 26A:
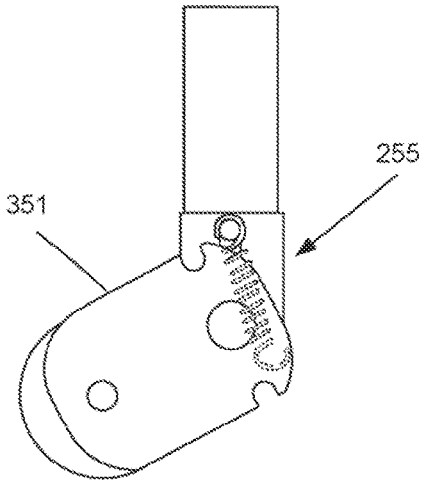
FIG. 26A shows a fourth preferred embodiment of the present disclosure.
Figure 26B:
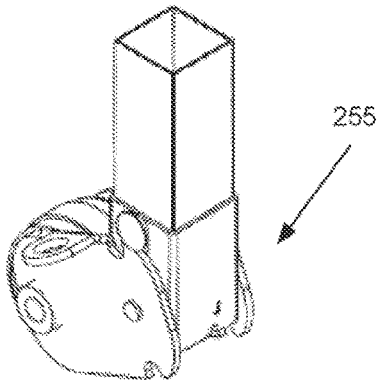
FIG. 26B shows a fourth preferred embodiment of the present disclosure.

In FIG. 26A-26B the user has rotated wheel bracket 351 further clockwise.

Figure 27:
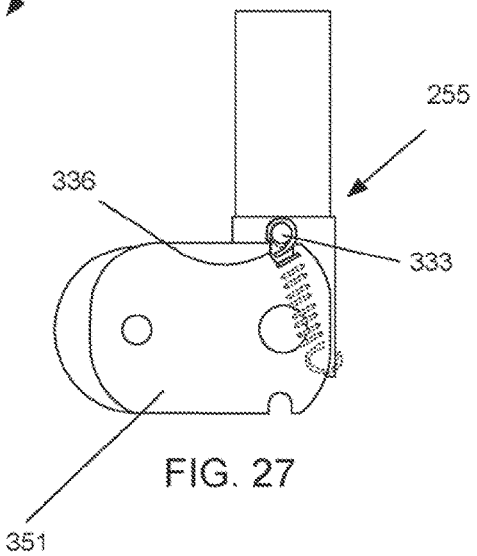
FIG. 27 shows a fourth preferred embodiment of the present disclosure.

In FIG. 27 the user has rotated wheel bracket 351 clockwise so that it is facing to the left and slot 336 is underneath spring bar 333.

Figure 28:
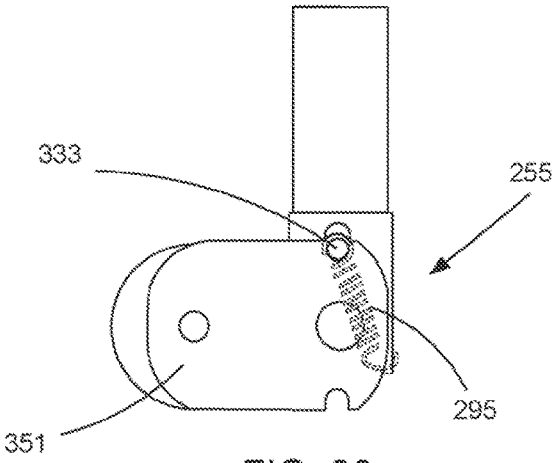
FIG. 28 shows a fourth preferred embodiment of the present disclosure.
Figure 29:
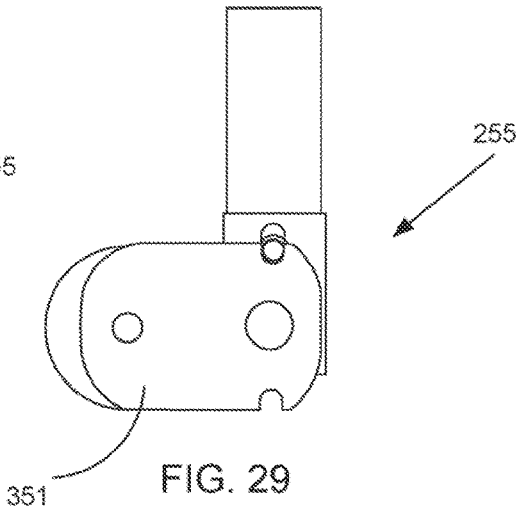
FIG. 29 shows a fourth preferred embodiment of the present disclosure.

In FIGS. 28 and 29, the user has release spring bar 333 allowing spring 295 to pull spring bar 333 down into slot 336, thereby locking wheel bracket 351 in the left facing position shown.

Figure 30:
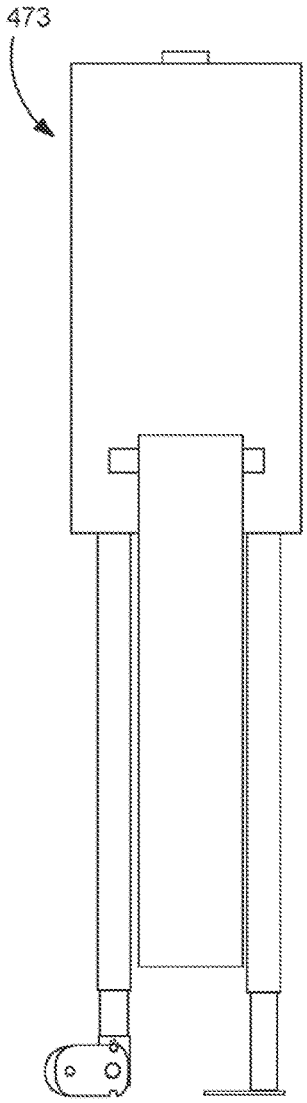
FIG. 30 shows a fourth preferred embodiment of the present disclosure.

In FIG. 30, wheel bracket 351 is facing left and ready to provide mobility for collapsed canopy 473.

Figure 31:
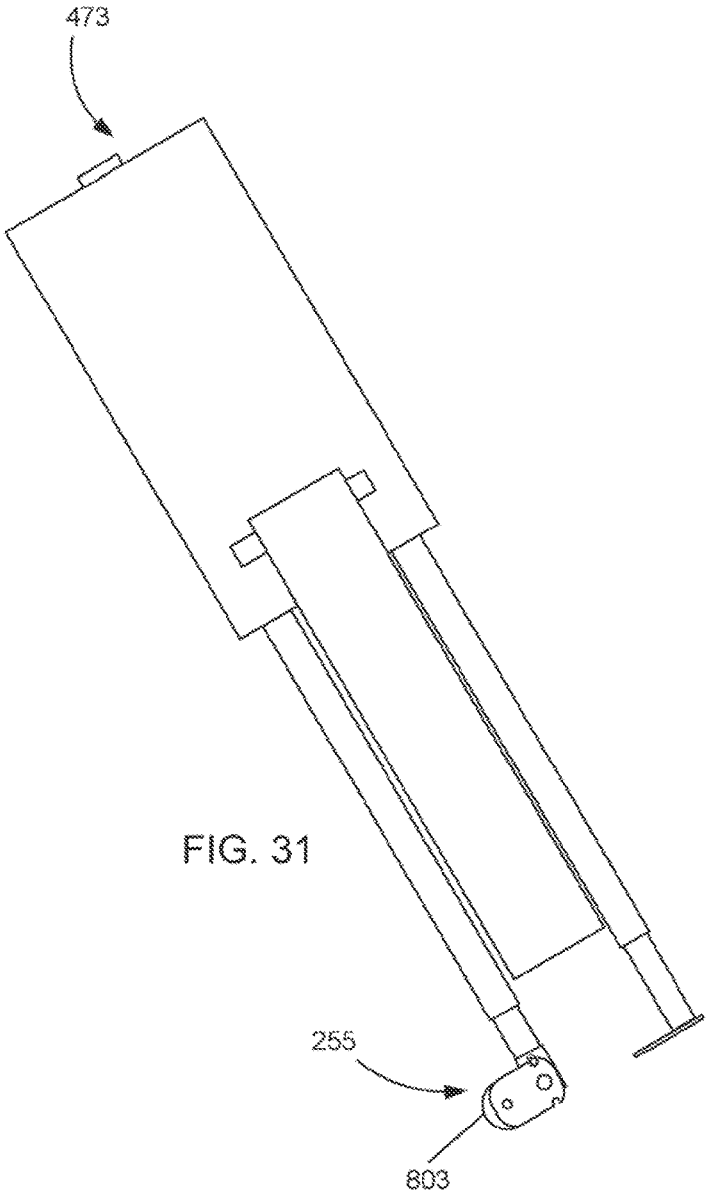
FIG. 31 shows a fourth preferred embodiment of the present disclosure.

In FIG. 31, the user has tilted collapsed canopy 473 and can now pull it to the left. Canopy 473 will roll easily on wheels 803 of wheeled mechanism 255.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

Fifth Preferred Embodiment

FIG. 32 to FIG. 37 show a portable collapsible canopy, the canopy comprises a canopy body 1 and a protective cover 2 for accommodating the canopy body 1, the canopy body 1 is foldable, the canopy has an unfolded state and a folded state, and the canopy body 1 comprises a support frame that can be unfolded and folded, and a fabric cover that is capable of being unfolded and folded along with the support frame. When the canopy is in the folded state, the protective cover 2 can sleeve over the folded canopy body 1 and at least cover the support frame. The canopy body 1 further comprises a plurality of legs, the plurality of legs comprises wheeled legs 11 and non-wheeled legs 12, wherein the lower end portion of each of the wheeled legs 11 is provided with a wheel 13, and the legs without wheels are the non-wheeled legs 12. When the canopy is in the folded state, the protective cover 2 covers the canopy body 1, and is detachably connected to the lower end portions of the legs 11 and/or 12 via connecting members 22. Specifically, when the canopy is in the folded state, the protective cover 2 is detachably connected to the lower end portions of the two wheeled legs 11 via connecting members 22. When the canopy needs to be unfolded, the connecting members 22 and the lower end portions of the wheeled legs 11 are disconnected, and the canopy can be unfolded.

Further, each of the wheeled legs 11 and the non-wheeled legs 12 comprises an outer leg, an inner telescoping leg that are telescoping with respect to the outer leg, and a foot pad 14, upper end portions of the outer legs are connected to the support frame, the inner telescoping legs are slidably disposed inside the outer legs in the up-down direction, and the foot pads 14 can be supported on the ground and have flat shaped bodies. In addition, each of the wheeled legs further comprises a wheel mounting seat 13*a*, the wheel 13 is rotatably disposed on the wheel mounting seat 13*a*, and the wheel mounting seat 13*a* is disposed on the lower end portion of the inner telescoping leg. The foot pads 14 are disposed on the lower end portions of the inner telescoping legs or on the wheel mounting seats 13*a*. When the canopy is in the folded state, the height of the respective wheeled legs 11 is equal to the height of the respective non-wheeled legs 12. When the canopy is in the folded state, most of the inner telescoping legs are accommodated within the outer legs, and the outer legs and the support frame are covered in the protective cover 2.

Each of the connecting members 22 comprises a connecting strap 222 and a connecting piece 221, the connecting strap 222 may be a strap having an upper end portion and a lower end portion, the upper end portion is connected to the lower edge of the protective cover 2 by sewing, and the connecting piece 221 is disposed at the lower end portion of the connecting strap (for example, by sewing). The connecting pieces 221 are detachably connected to the lower end portions of the wheeled legs 11, in particular, each of the wheel mounting seat 13*a* is provided with an insertion hole 15, the connecting piece 221 is detachably inserted into the insertion hole 15, and the connecting piece 221 has a shape similar to a pin. There are two wheeled legs 11, so that there are at least two wheels 13, and the two wheels 13 roll on the ground, so that the folded canopy can move smoothly and convenient.

Figure 33:
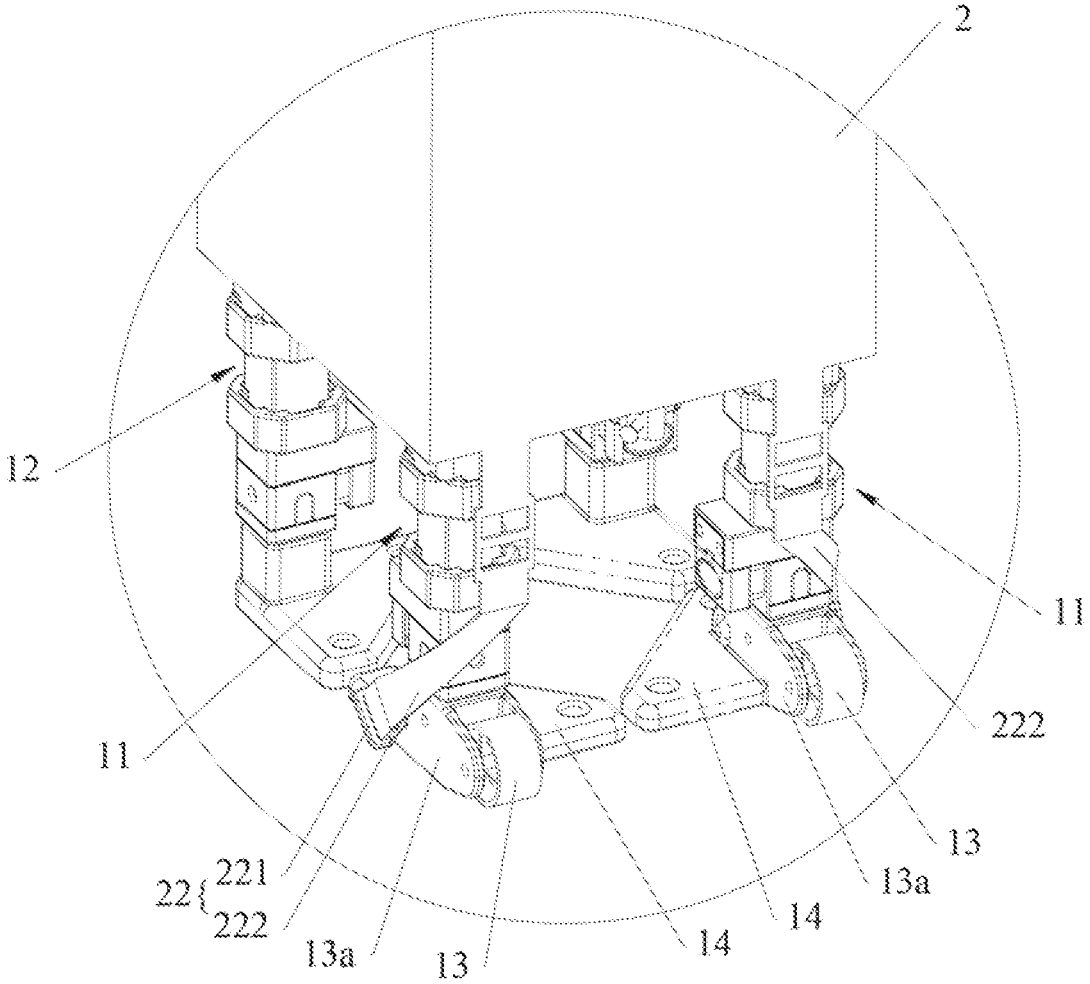
FIG. 33 is an enlarged view of Part A in FIG. 32.
Figure 34:
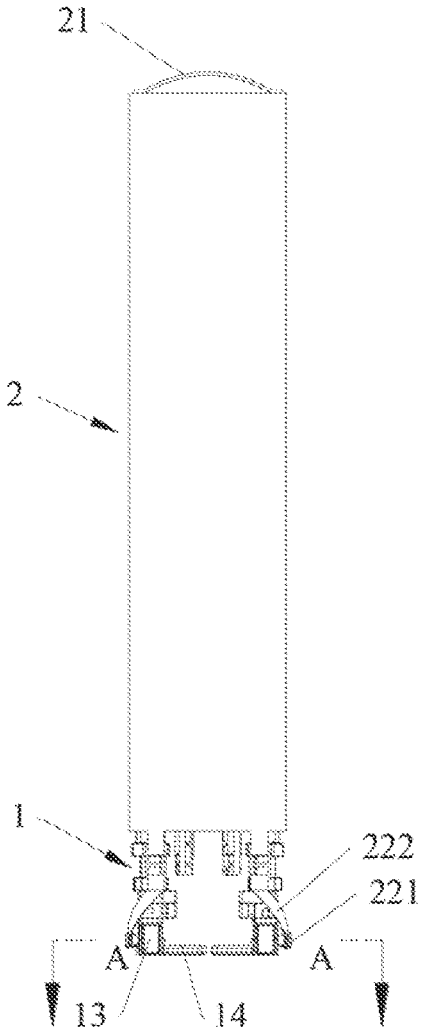
FIG. 34 is a front view of the canopy shown in FIG. 32.
Figure 35:
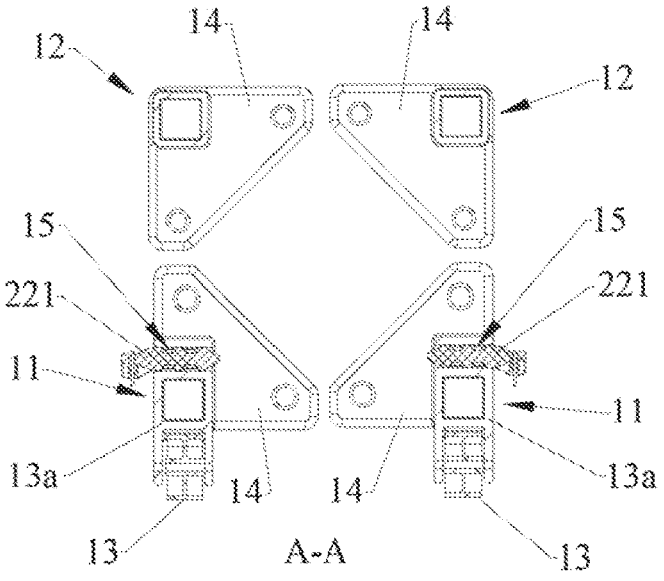
FIG. 35 is a cross-sectional view along A-A in FIG. 32.
Figure 36:
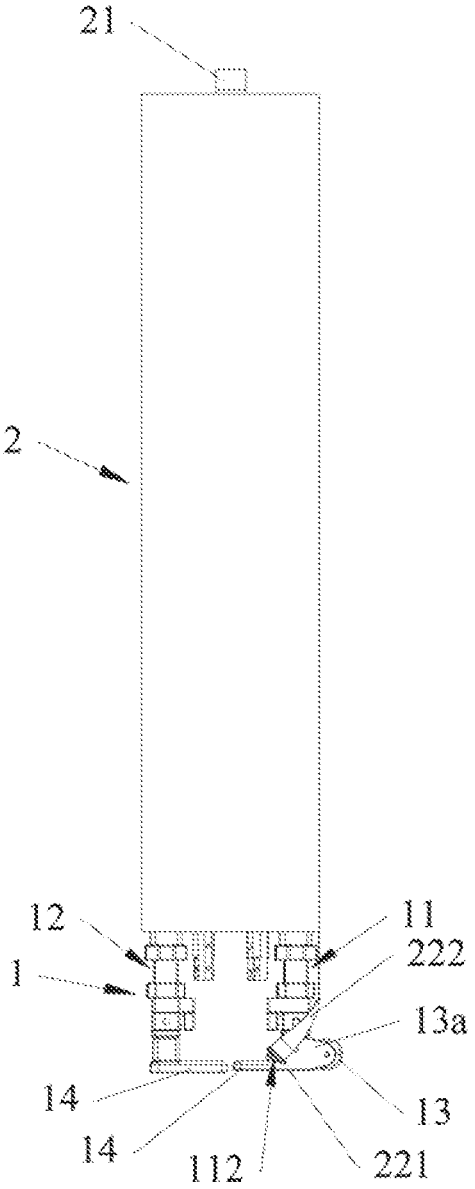
FIG. 36 is a side view of the canopy shown in FIG. 32.

When the canopy stands upright on the ground, the lowest portion of the wheels 13 are not lower than the lowest portion of the foot pads 14. That is to say, when the canopy is unfolded or folded, the foot pads 14 are all supported on the ground, and the canopy stands upright on the ground steadily through the foot pads 14 at the lower end portions of the legs, at the moment, the wheels 13 do not contact the ground or do not move the canopy despite contact. Only when pull the upper portion of the canopy in the folded state to tilt it, only the wheels 13 are in contact with the ground, and the canopy can be moved by rolling under the action of an external pull. That is, when the canopy is tilted to the ground, the lowest portion of the wheels 13 are lower than the lowest portion of the foot pads 14 and can roll on the ground. As shown in FIG. 33 and FIG. 36, each of the wheel 13 is rotatably disposed on the outer side portion of the foot pad 14 via axle, and part of the wheel 13 protrudes to the outside of the foot pad 14 (specifically, the front side of the foot pad 14), and the axle extends horizontally in the left-right direction. Here, the orientation words "inner", "inside", "outer" and "outside" are defined with reference to the longitudinal centerline of the canopy, and the side closer to the longitudinal centerline of the canopy is defined as outer or outside, and the opposite is inner or inside. Orientation words such as "left" and "right" are based on the orientation in the drawings.

Figure 32:
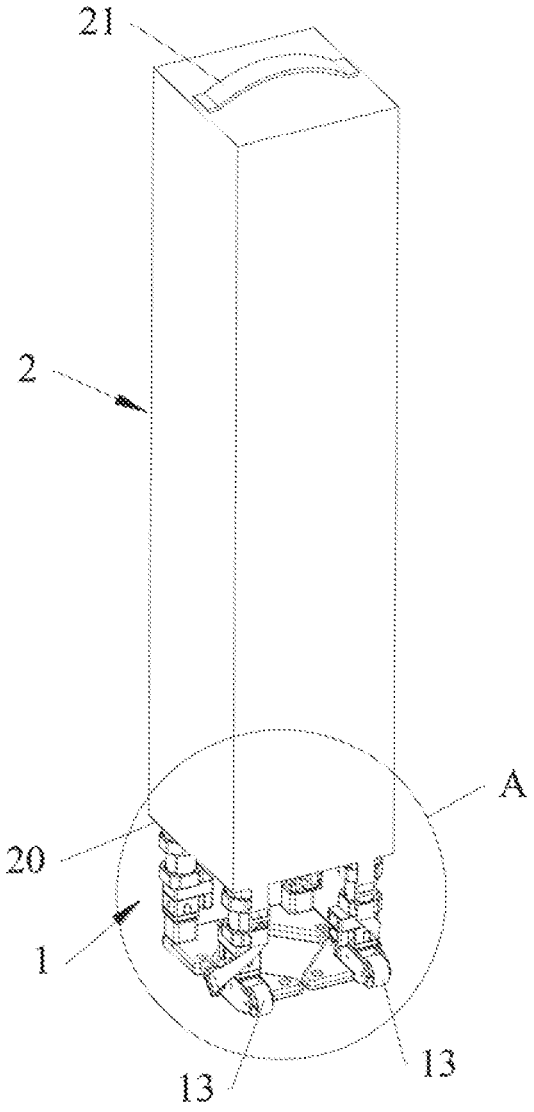
FIG. 32 shows a fifth preferred embodiment of the present disclosure.

The total number of legs is three or more, the folded canopy body 1 is in the shape of a prism as a whole, and the number of side edges and the number of side faces correspond to the number of legs, such as triangular prisms, quadrangular prisms, etc. The above-mentioned protective cover 2 has a shape corresponding to the prism formed by the folded canopy body 1 and has a plurality of side faces. Specifically, in the canopy body 1 of this embodiment, there are four legs, so the protective cover 2 is in the shape of a cuboid with an open lower end, and has four side faces. The four legs include two wheeled legs 11 and two non-wheeled legs 12, and the lower end portions of the two wheeled legs 11 are respectively provided with wheels 13. The two wheeled legs 11 are located on the same side of the canopy rather than diagonally, as shown in FIG. 32, on the front side.

In this embodiment, there are two connecting members 22, and there are two connecting straps 22, the lower end portion of each connecting strap 22 is provided with a connecting piece 221, which is detachably inserted into the respective insertion hole 15 on the two-wheel mounting seats 13*a*. The centerlines of the insertion holes 15 extend horizontally in the left-right direction. In some other embodiments, there may be one connecting member 22, and the two-wheel mounting seats 13*a* are connected together through one connecting member 22.

Figure 37:
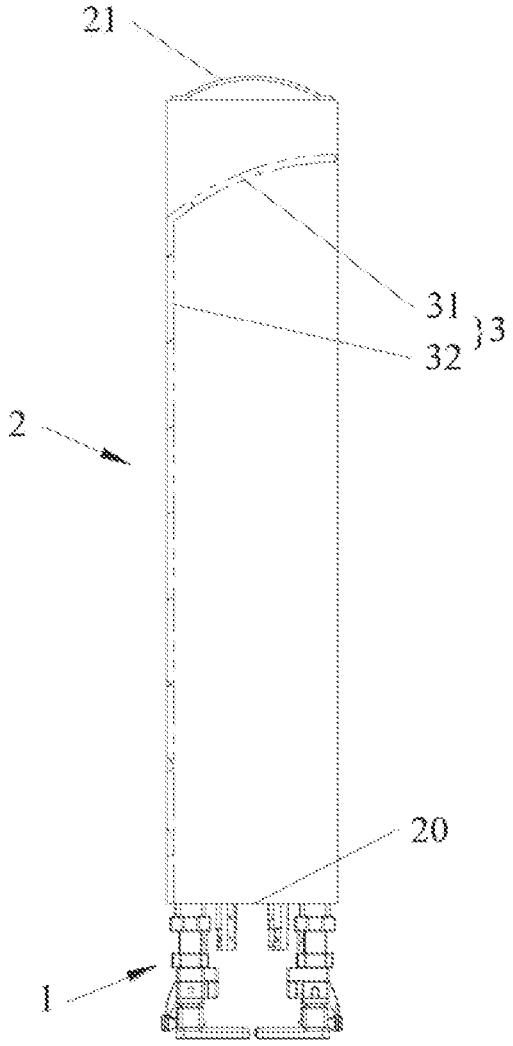
FIG. 37 is a rear view of the canopy shown in FIG. 32.

The above-mentioned protective cover 2 is provided with an inlet 20 for the folded canopy to enter, and the inlet 20 is open and faces downward. The above-mentioned protective cover 2 is further provided with a notch portion extending upward from the inlet 20, and a zipper 3 for opening or closing the notch portion, the notch portion and the inlet 20 are in communication with each other. As above, the protective cover 2 has four side faces, and the notch portion and the zipper 3 are disposed on one of the side faces of the protective cover 2 (specifically, the rear side face as shown in FIG. 37). The zipper 3 is composed of a linear segment 32 and a guide segment 31 which are connected. The linear segment 32 is located at the left edge of the rear side face of the protective cover 2 and extends upward from the inlet 20. The guide segment 31 extends from the left edge to the right edge of the protective cover 2 along an oblique line or an arc, the lower end of the guide segment 31 is connected to the upper end of the linear segment 32, and the upper end of the guide segment 31 is higher than the lower end of the guide segment 31. Specifically in this embodiment, as shown in FIG. 37, the guide section 31 extends along an arc, and the center of the arc is located on the lower side of the arc. The use of the zipper 3 with the arc-shaped or inclined guide segment 31 can avoid the following problems: if a zipper 3 extending straight up and down is used, when the canopy body 1 is put in the protective cover 2, especially in the initial stage of sheathing, it is difficult for the canopy body 1 to enter the protective cover 2; when the canopy body 1 is put in, it is difficult to zip up the zipper 3, and the zipper 3 is not smooth enough. The use of the zipper 3 with an arc-shaped or inclined guide segment 31 can better solve the above problems, and when the canopy body 1 is put in, the size of the notch gradually changes, which has a guiding effect, and the canopy body 1 is easier to put into the protective cover 2, and the zipper 3 can be zipped up relatively smoothly after the canopy body is put in, which is convenient for users to use; in addition, the appearance is also relatively beautiful.

The upper end of the protective cover 2 is fixedly connected with a handle 21, which is convenient for the user to pull and move the canopy.

When the canopy is folded, the protective cover 2 is sleeved on the canopy in the folded state, the lower portion of the support frame and the bottom of the legs (including the wheels 13) are located outside the protective cover 2, and the connecting pieces 221 on the protective cover 2 are inserted into the insertion holes 15 on the wheel mounting seats 13*a*, then the user can tilt the protective cover 2 and the canopy body 1 therein forward by grasping the handle 21 on the protective cover 2, so that the wheels 13 land on the ground and the foot pads 14 are off the ground, and at this moment, the canopy body 1 can roll forward on the ground accordingly as the user moves forward. During this process, since the connecting pieces 221 on the protective cover 2 are connected to the wheel mounting seats 13*a*, if the wheels 13, the foot pads 14 or the lower portions of the supporting legs exposed outside the protective cover 2 are blocked or hooked by other objects, due to that the protective cover 2 is connected to the wheel mounting seats 13*a* through the connecting members 22, in the case of low resistance, the protective cover 2 can still drive the wheels 13, the foot pads 14, etc. to move forward through the connecting pieces 221, and in the case of high resistance, the protective cover 2 and the entire canopy body 1 will stop until the obstruction is eliminated; there will be no situation where the protective cover 2 and the upper portion of the canopy body 1 therein move forward and the wheels 13, the foot pads 14, etc. are blocked and stay in place, so as to avoid the accidental extension of the legs or even the accidental unfolding of the canopy during the moving process, thereby avoiding damage to the canopy.

Sixth Preferred Embodiment

Figure 38:
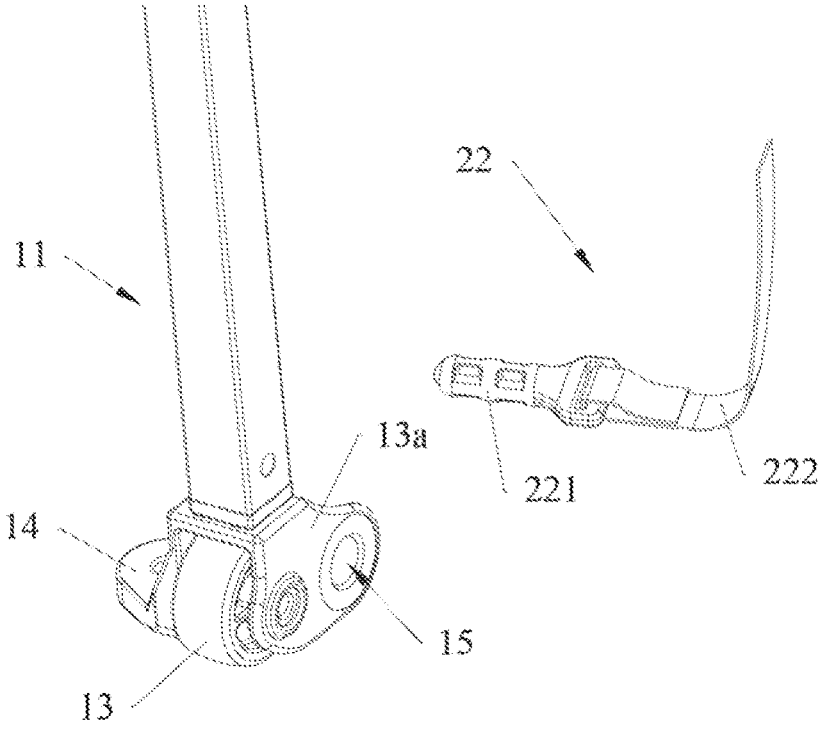
FIG. 38 shows a part of a sixth preferred embodiment of the present disclosure.

The difference between this embodiment and the fifth preferred embodiment is mainly that the shapes of the wheels 13 and the wheel mounting seats 13*a* are different, as shown in FIG. 38.

Seventh Preferred Embodiment

Figure 39:
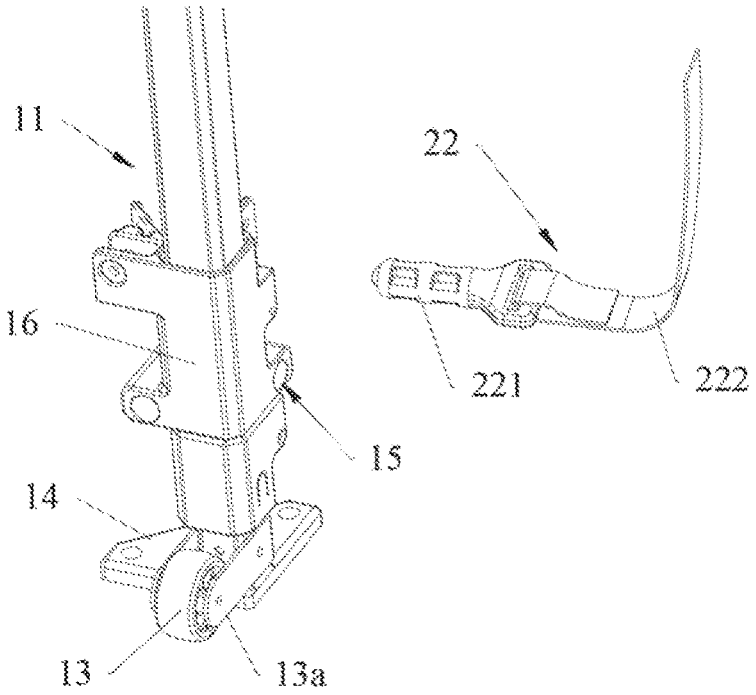
FIG. 39 shows a part of a seventh preferred embodiment of the present disclosure.

The difference between this embodiment and the fifth preferred embodiment is mainly that the positions of the insertion holes 15 are different, as shown in FIG. 39. Each of the wheeled leg 11 further comprises a sliding sleeve 16 movably connected to the outer leg or the inner telescoping leg, and the insertion hole 15 is disposed on the sliding sleeve 16. The sliding sleeve 16 may be used for connecting the support frame.

Eighth Preferred Embodiment

Figure 40:
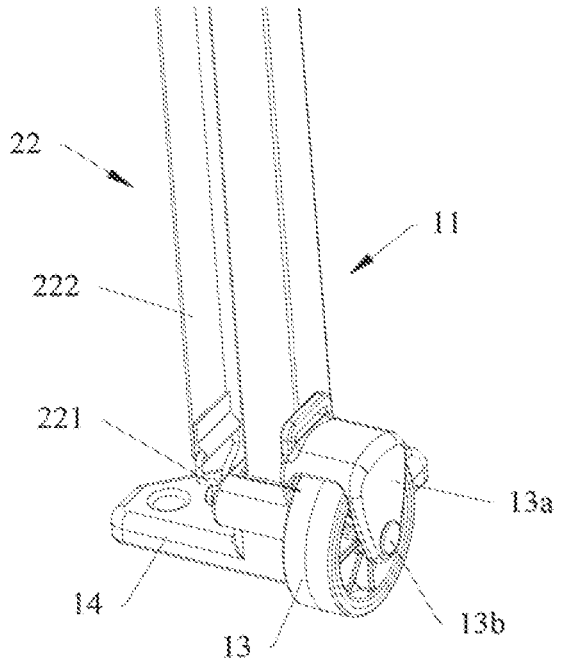
FIG. 40 shows a part of an eighth preferred embodiment of the present disclosure.
Figure 41:
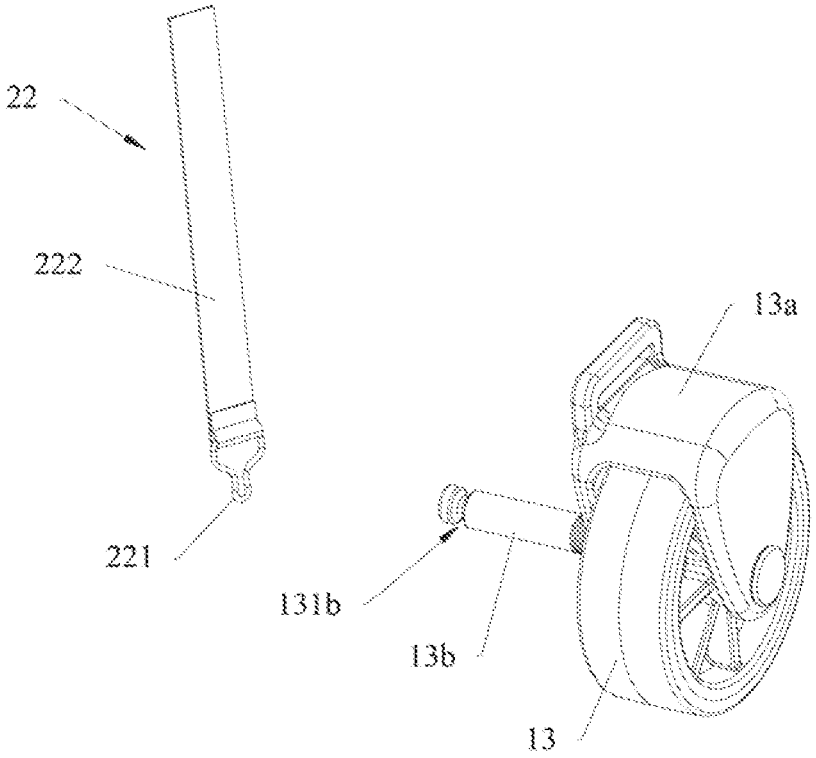
FIG. 41 shows a part of the eighth preferred embodiment of the present disclosure.

The difference between this embodiment and the fifth preferred embodiment is mainly that the connecting pieces 221 and the wheel mounting seats 13*a* are different, as shown in FIG. 40 and FIG. 41. The wheeled legs 11 have connecting pins, which extend horizontally or obliquely. The connecting pieces 221 are hooks that can be hung on the connecting pins; the connecting pins are provided with grooves 131*b* for holding the hooks therein.

Further, the wheel mounting seats 13*a* are detachably connected to the lower end portions of the inner telescoping legs of the wheeled legs 11. The lower end portions of the inner telescoping legs are provided with through holes, the wheels are rotatably disposed on the wheel mounting seats 13*a* through the axles 13*b*, and after the axles 13*b* pass through the through holes, the wheel mounting seats 13*a* and the wheels 13 thereon are assembled on the inner telescoping legs, and can be quickly disassembled when not in use. The portions of the axles 13*b* passing through the inner telescoping legs are the above-mentioned connecting pins, and when the axles 13*b* are inserted so that the wheels 13 are installed on the inner telescoping legs, the hooks are caught in the grooves 131*b* of the connecting pins to fix the protective cover.

Ninth Preferred Embodiment

Figure 42:
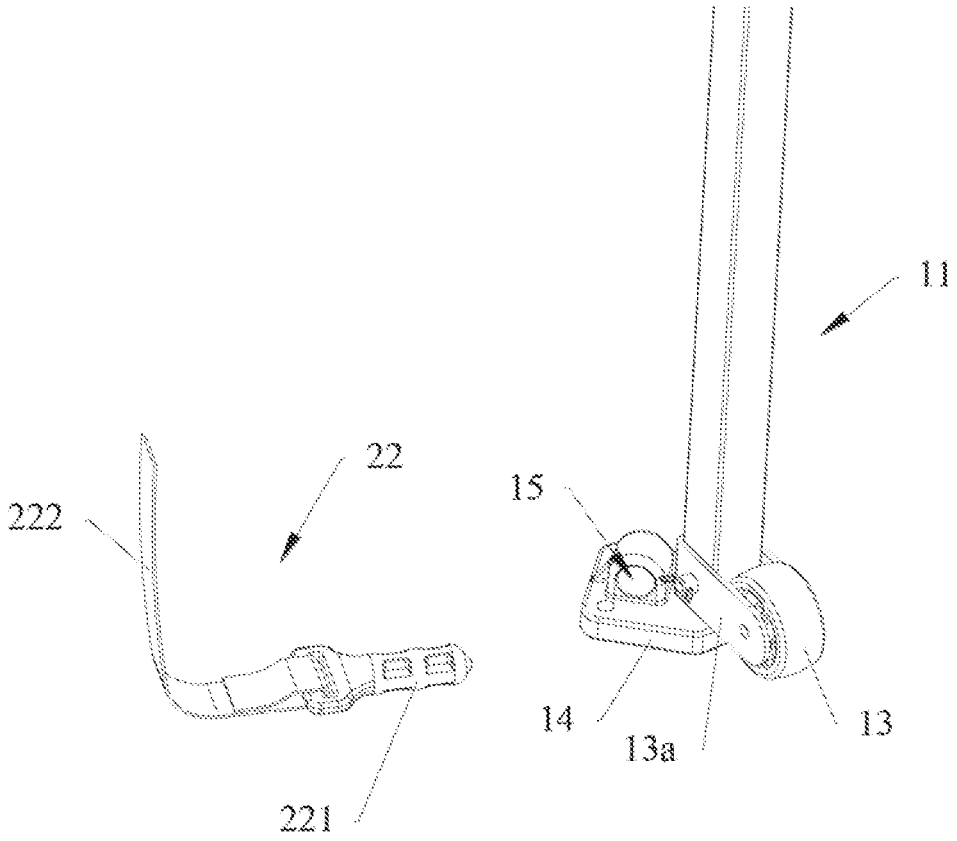
FIG. 42 shows a part of a ninth preferred embodiment of the present disclosure.
Figure 43:
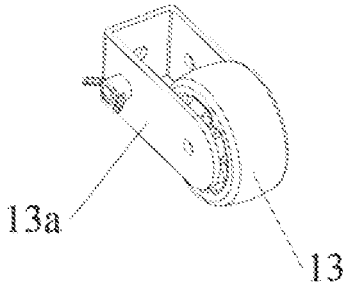
FIG. 43 shows a part of the ninth preferred embodiment of the present disclosure.

The difference between this embodiment and the fifth preferred embodiment is mainly that the positions of the insertion holes 15 and the wheel mounting seats 13*a* are different, as shown in FIG. 42 and FIG. 43. The insertion holes 15 are disposed on the foot pads 14.

Further, the wheel mounting seats 13*a* are detachably connected to the lower end portions of the inner telescoping legs of the wheeled legs 11. In use, the wheel mounting seats 13*a* and the wheels 13 thereon are assembled on the inner telescoping legs of the wheeled legs 11, and can be quickly disassembled when not in use.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

What is claimed is:

1. A collapsible canopy, for sun shading or sheltering in an unfolded state and movable in a folded state, comprising:

a support frame;

a plurality of legs with upper portions connected to the support frame;

a protective cover for covering the support frame when the collapsible canopy is in the folded state; and a handle for a user to grasp to pull the collapsible canopy when the collapsible canopy is in the folded state, wherein the handle is connected to the protective cover;

wherein at least two of the plurality of legs are wheeled legs which are provided with wheels, the protective cover is detachably connected to the wheeled legs through connecting members when the collapsible canopy is in the folded state;

wherein each of the connecting members comprises:

a connecting strap having an upper end portion and a lower end portion, the upper end portion of the connecting strap is connected to the protective cover; and a connecting piece disposed at the lower end portion of the connecting strap and detachably connected to the legs;

wherein each of the wheeled legs is provided with an insertion hole and is detachably connected to the connecting member, and when the collapsible canopy is in the folded state, the connecting piece is detachably inserted into the insertion hole.

2. The collapsible canopy as in claim 1, wherein each of the wheeled legs comprises a wheel mounting seat, a wheel is disposed on the wheel mounting seat, and the insertion hole is disposed on the wheel mounting seat.

3. The collapsible canopy as in claim 1, wherein each of the wheeled legs comprises a foot pad capable of being supported on a ground, and the insertion hole is disposed on the foot pad.

4. The collapsible canopy as in claim 1, wherein each of the wheeled legs has a sliding sleeve capable of sliding up and down, and the insertion hole is disposed on the sliding sleeve.

5. The collapsible canopy as in claim 1, wherein the connecting strap is a woven strap.

6. The collapsible canopy as in claim 1, wherein each of the wheeled legs comprises a leg body and a wheel mounting seat, a wheel is disposed on the wheel mounting seat, and the wheel mounting seat is detachably connected to the leg body.

7. The collapsible canopy as in claim 1, wherein each of the wheeled legs comprises an outer leg and an inner telescoping leg that is telescoping with respect to the outer leg, an upper end portion of the outer leg is connected to the support frame, and a wheel is disposed on an lower end portion of the inner telescoping leg; and when the collapsible canopy is in the folded state, all the legs are equal in height.

8. The collapsible canopy as in claim 1, wherein each of the legs comprises a foot pad capable of being supported on a ground, and when the collapsible canopy is in the folded state and stands upright on the ground, a lowest portion of the wheels is not lower than a lowest portion of the foot pads; and when the collapsible canopy is in the folded state and is tilted to the ground, the lowest portion of the wheels is lower than the lowest portion of the foot pads and capable of rolling on the ground.

9. The collapsible canopy as in claim 1, wherein one or more of the plurality of legs are non-wheeled legs.

10. The collapsible canopy as in claim 1, wherein the protective cover is provided with an inlet being open and facing downward, and when the collapsible canopy is in the folded state, lower portions of the support frame and/or the legs are located outside the protective cover.

11. The collapsible canopy as in claim 1, wherein the protective cover is further provided with a notch portion extending upward from an inlet, and a zipper for opening or closing the notch portion, the notch portion and the inlet are in communication with each other, and the zipper has a guide segment extending along an oblique line or an arc.

* * * * *